United States Patent [19]

Toder

[11] Patent Number: 4,599,763

[45] Date of Patent: Jul. 15, 1986

[54] HINGED CEILING TRACK

[76] Inventor: Ellis I. Toder, 341 Militia Hill Rd., Fort Washington, Pa. 19034

[21] Appl. No.: 637,301

[22] Filed: Aug. 3, 1984

[51] Int. Cl.[4] ..... E05D 15/06

[52] U.S. Cl. ..... 16/94 D; 16/95 D; 16/232

[58] Field of Search ..... 16/94 R, 94 D, 95 R, 16/95 D, 95 W, 95 DW, 96, 96 R, 96 D, 96 L, 231, 232; 292/83, 306; 104/100, 103; 238/165, 166; 403/322

[56] References Cited

U.S. PATENT DOCUMENTS

| | | | |
|---|---|---|---|
| 293,339 | 2/1884 | Martin | 16/96 R |
| 1,267,279 | 5/1918 | Scalpelli | 238/166 |
| 2,804,326 | 8/1957 | Newcomer, Jr. | 292/83 |

*Primary Examiner*—Fred Silverberg

*Attorney, Agent, or Firm*—Walter B. Udell

[57] ABSTRACT

A ceiling track having a hinged terminal section incorporating a latch at the free end of the hinged section to secure the track end to the ceiling, the latch being releasable from floor level by an actuating wand to allow the hinged section to pivot downward to allow a curtain or other track carried equipment to be installed into or pulled down out of the track for easy removal, and being restorable to operation by pivoting the hinged track section upward into latching engagement in its operative ceiling affixed position. The latching structure is in two sections, one of which is fixedly secured to the end of the track and the other of which is fixedly secured to the above lying support surface, and incorporates a double latch for safety purposes, each latch being independent of the other, but both latches being simultaneously actuatable to latch and unlatch the latching mechanism.

14 Claims, 9 Drawing Figures

FIG. 1
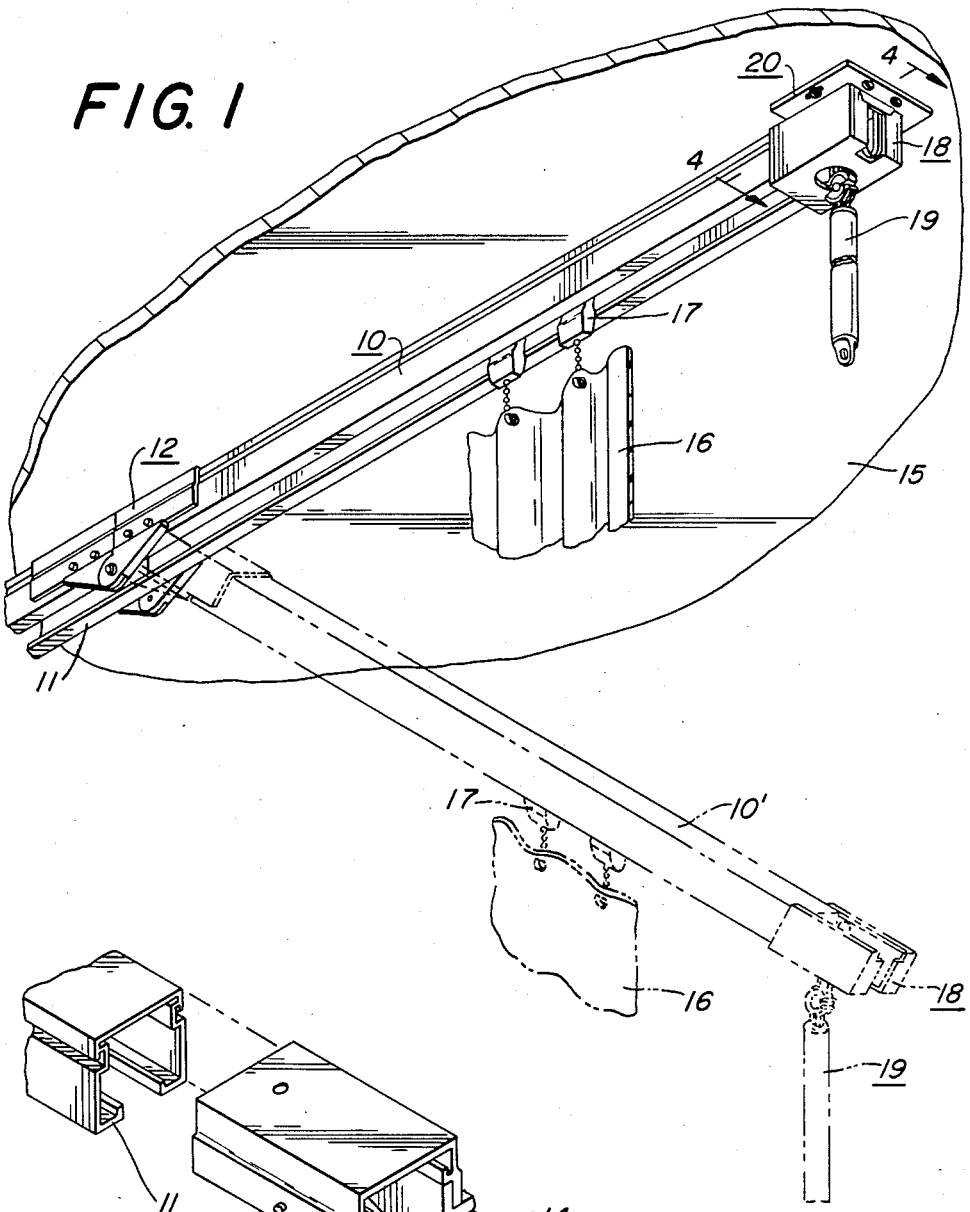
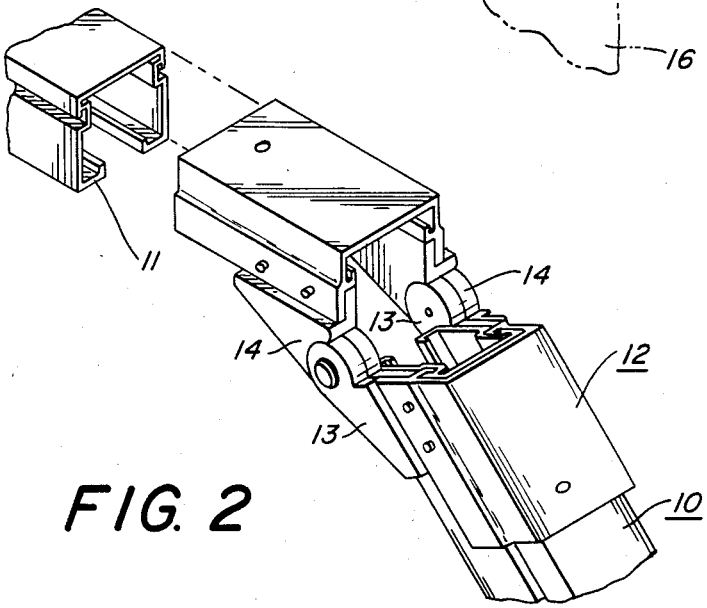
FIG. 2

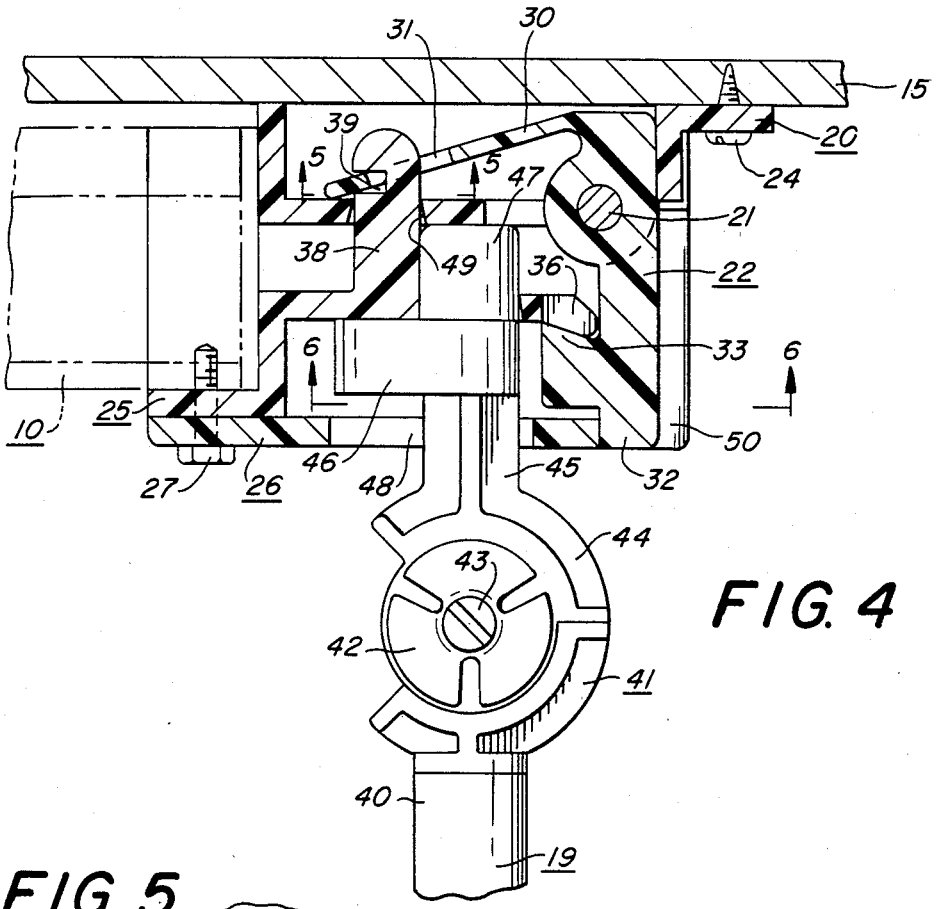
FIG. 4
FIG. 5
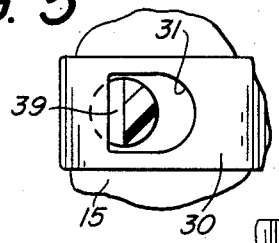
FIG. 6
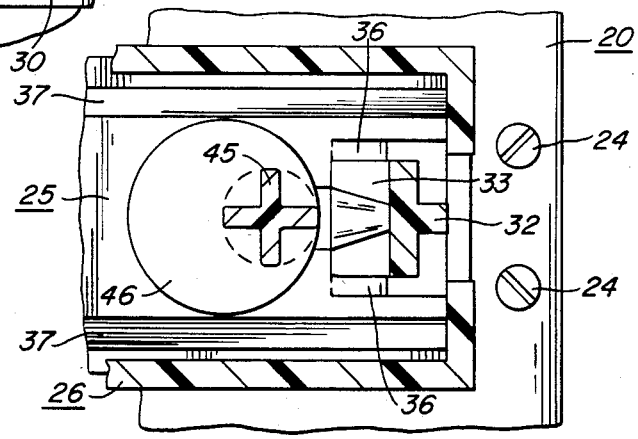

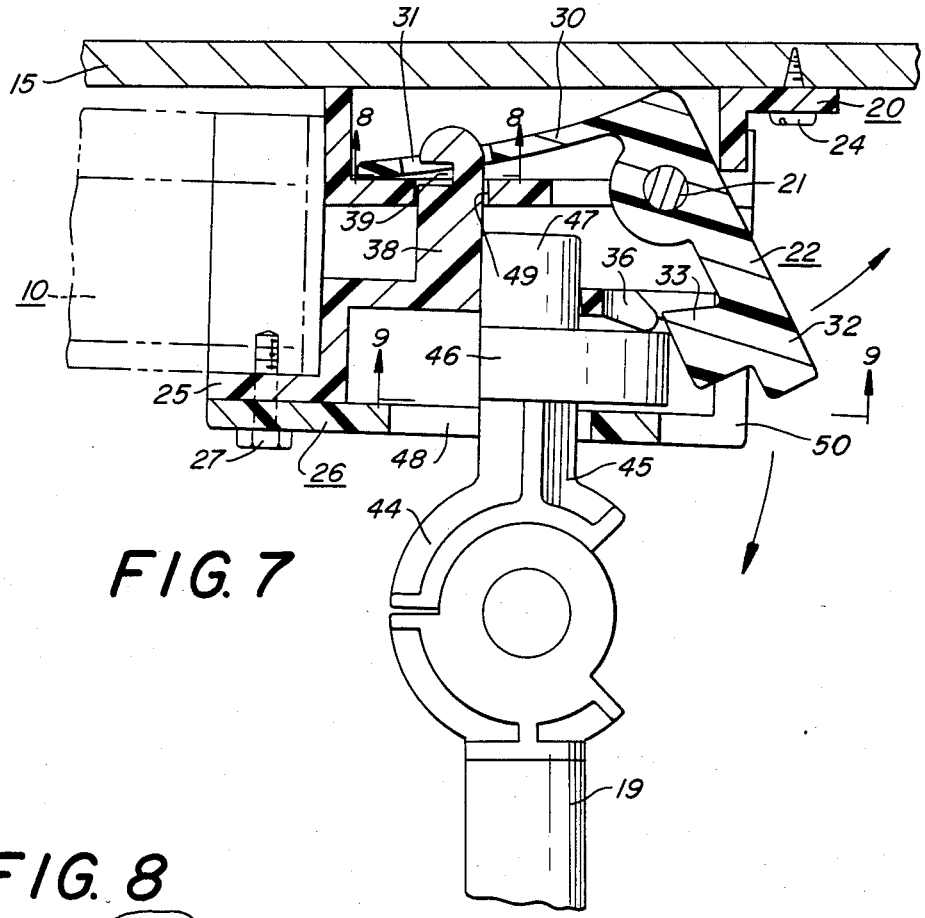
FIG. 7
FIG. 8
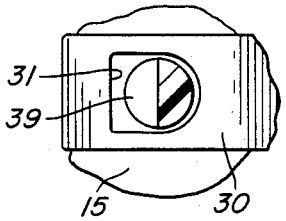
FIG. 9
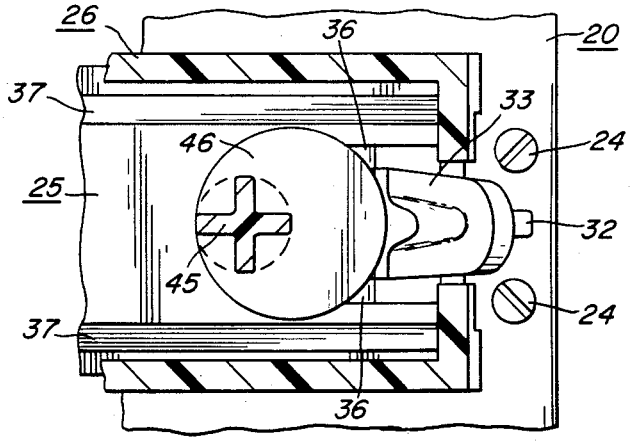

HINGED CEILING TRACK

This invention relates generally to ceiling tracks for use with travelling curtains such as are found in hospital cubicle track systems for establishing privacy around the bed of a patient.

In the past, it has been necessary to install and remove the curtains which are suspended from the ceiling track for traverse therein by securing the top edge of the curtain at a number of points to carriers which are disposed within the track. This is a time consuming process, and, more significantly, it requires that the person doing the installing or removing of the curtain have access to the connection points between the curtain and the carriers, which are located at the ceiling level. This requires the use of ladders and is a cumbersome and sometimes dangerous procedure.

The ceiling track according to the invention eliminates the problems by providing a hinged terminal section incorporating a latch at the free end of the hinged section to secure the track end to the ceiling, the latch being releasable from floor level to allow the hinged section to pivot downward and thereby allow the curtain to be pulled down out of the track on its carriers for easy removal. Similarly, a curtain may be loaded into the track on its carriers, pulled along up into the track, and then the system may be restored to operation by pivoting the hinged track section upward into latching engagement in its operative ceiling affixed position. Alternatively, with the track in its downward pivoted position, the curtain may be connected to and disconnected from the curtain carriers in the track without removing the curtain carriers from the track.

It is a primary object of the invention to provide a novel hinged ceiling track structure including a track section having a free end latchable to an above-lying supporting surface.

Another object of the invention is to provide a novel hinged ceiling track structure as aforesaid in which the latching structure for the track end is unlatchable and latchable from floor level to allow the hinged section to pivot downward for installation and removal of track carried articles, such as cubicle curtains and equipment hangers.

A further object of the invention is to provide a novel hinged ceiling track structure as aforesaid in which the latching structure is in two sections, one of which is fixedly secured to the end of the track and the other of which is fixedly secured to the above lying support surface, the two latchable sections being operable from floor level by insertion of an actuating wand.

Yet another object of the invention is to provide a novel latching mechanism which incorporates a double latch for safety purposes, each latch being independent of the other, but both latches being simultaneously actuatable to latch and unlatch the latching mechanism.

The foregoing and other objects of the invention will become clear from a reading of the following specification in conjunction with an examination of the appended drawings, wherein:

FIG. 1 is a perspective drawing showing the hinged ceiling track in installed operative position in solid line, and in detached dropped position in phantom line;

FIG. 2 is a perspective view of the hinge structure for the hinged track section;

FIG. 4 is a vertical sectional view, on an enlarged scale, through the track latching structure and actuating wand mechanism, as would be seen when viewed along the line 4—4 on FIG. 1;

FIG. 5 is a horizontal sectional view as would be seen when viewed along the line 5—5 on FIG. 4;

FIG. 6 is a horizontal sectional view, on an enlarged scale, as would be seen when viewed along the line 6—6 on FIG. 4;

FIG. 7 is a view similar to FIG. 4 but showing the latch in its unlocked position to permit the hinged track section to be tilted downward;

FIG. 8 is a horizontal sectional view as would be seen when viewed along the line 8—8 on FIG. 7; and FIG. 9 is a horizontal sectional view, on an enlarged scale, as would be seen when viewed along the line 9—9 on FIG. 7.

In the several figures, like elements are denoted by like reference characters.

Figure 3:
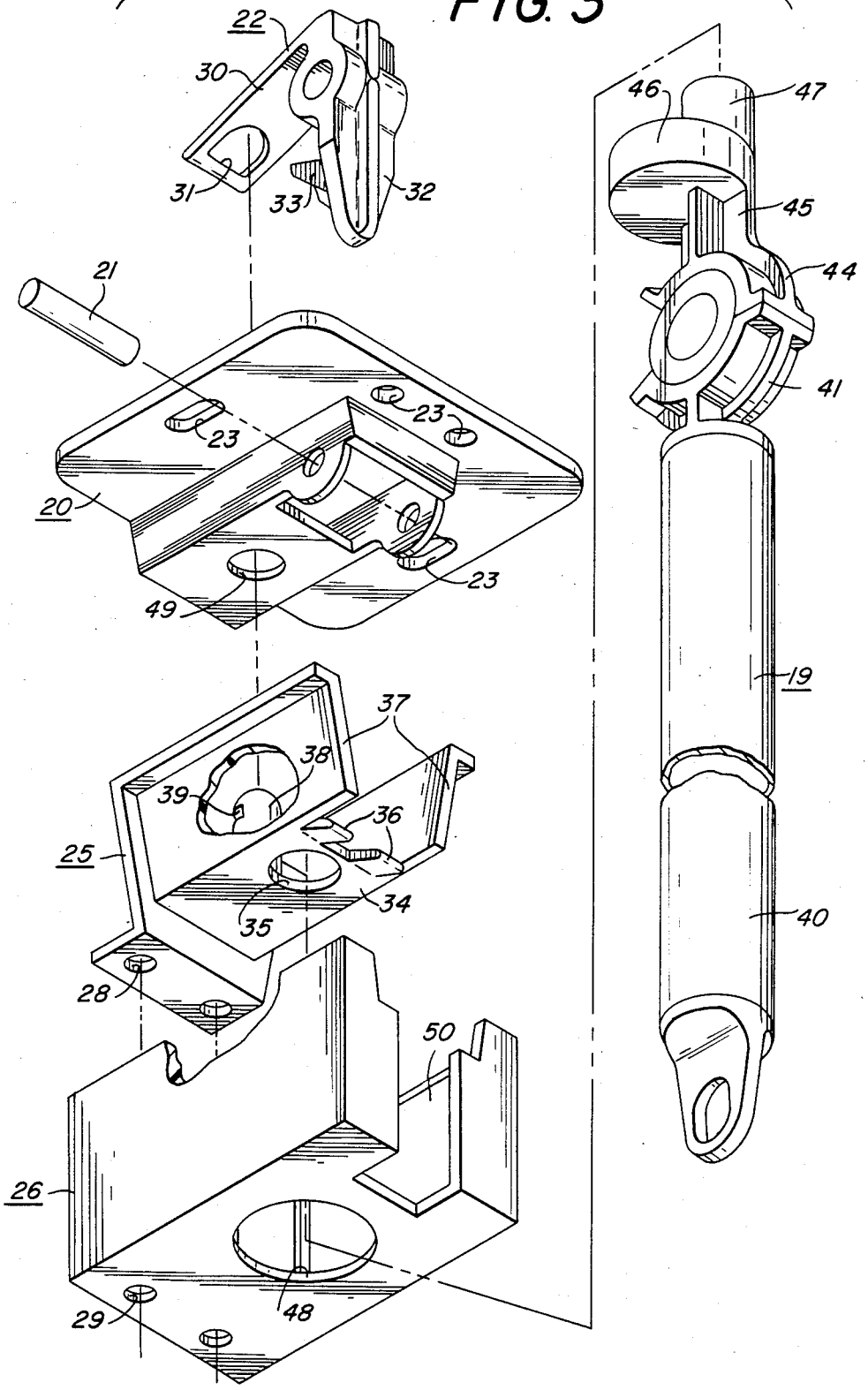
FIG. 3 is an exploded perspective view of the track latching structure and the actuating wand therefor.

Considering first FIGS. 1 and 2, there is seen a ceiling track structure including a hinged track section designated generally as 10 connected to a track section 11 by means of a hinged structure designated generally as 12. One end of the hinged track section 10 is fixed to one half-section of the hinge 12, designated as 13, while the other half of the hinge, designated as 14 is fixed to the track section 11. This hinge operates in a normal and usual fashion to allow the hinged track section 10 to be pivoted upward against the above lying ceiling 15, or pivoted downward as shown in the phantom line outline 10' into position for installing or removing the cubicle curtain 16 which moves within the track on its carriers 17. At the free end of the hinged track section 10 is a track latching mechanism designed generally as 18 which is operated by an actuating wand 19, the latching mechanism having a portion fixed to the ceiling and a portion carried at the end of the track 10, the two portions being detachably latchable to one another to secure and release the hinged track section 10.

Referring now to FIGS. 3 through 6 for details of the latching mechanism 18, there is seen a five part latching mechanism in which three parts are fixedly secured to the ceiling 15 and two parts are fixedly secured to the end of the hinged track section 10. The portion of the latching mechanism affixed to the ceiling 15 includes the latching plate 20 to which is pivotally secured by means of a pivot pin 21, a generally L-shaped resilient catch 22. The latching plate 20 is held to the ceiling by means of screws, not shown in FIG. 3, which are projected through the apertures 23 to anchor the plate 20 to the ceiling 15 as best seen in FIG. 4, the anchor screw being shown as 24. The screw 24 is only representational, in some cases it being necessary to use other types of fastenings such as toggle bolts.

The part of the track latching mechanism 18 which is secured to the free end of the hinged track section 10 includes a catch pin channel plate 25 and a cover shell 26, both of which are fixedly secured to the end of the hinged track section 10 by means of machine screws 27 projected through apertures 28 and 29. The actuating wand 19, although shown in operative position in FIG. 1, is not physically fixed to the track latching mechanism 18, but is an insertable and removable device, as appears from the showing of FIG. 3.

The resilient L-shaped catch 22 has a generally horizontally disposed leg 30, near the end of which is formed an aperture 31, and has a generally vertically disposed leg 32 toward the lower end of which is formed an upwardly sloped shelf 33. The catch pin channel plate 25 with which the L-shaped resilient catch 22 interengages, as shown in FIG. 4, is formed with a bottom wall 34 having therethrough a circular aperture 35, and having projected downward from the free end of the bottom wall and at an angle thereto a pair of projections 36 which are adapted to seat upon the shelf 33 of the resilient catch 22, as best seen in FIG. 4. Also extending upward from the bottom wall 34 of the catch pin channel plate 25 are a pair of side walls 37, and a catch pin 38 having a horizontal slot 39. The head of the catch pin 38 is adapted to be projected upward through the aperture 31 in the generally horizontal leg 30 of the resilient catch 22 to that the end of the leg 30 catches within the horizontal slot 39 when the latch is in its latched position as shown in FIG. 4, this interengagement being released when the latch is in its unlatched position as shown in FIG. 7 so that the catch pin 38 will be enabled to slip downward out through the aperture 31 and disengage from the resilient catch 22.

The actuating wand 19 has a long handle 40 surmounted by a hinge 41, the two halves of which are frictionally engaged with one another by means of an adjustable compression washer 42, the pressure exerted by the compression washer 42 being controlled by the adjusting screw 43. The upper section 44 of the hinge 41 is surmounted by a short extension 45 at the upper end of which is formed a circular cam 46 which is itself surmounted by a circular guide end post 47 which is projectable upward through the circular aperture 35 in the catch pin channel plate 25 when the actuating wand 19 is inserted upward through the aperture 48 in the cover shell 26 to actuate the latch mechanism.

Referring now specifically to FIGS. 4, 5 and 6, the latch mechanism is shown in its latched position so that the track 10 is securely latched to the ceiling by means of the latching plate 20 which is secured to the ceiling. As best seen in FIG. 4, in the latched condition, the head of the catch pin 38 is projected through the circular aperture 49 in the latching plate 20 and the aperture 31 in the horizontal leg 30 of the resilient catch 22, and at the same time the projections 36 which extend from the end of the bottom wall 34 of channel plate 25 are seated downward upon the shelf 33 formed on the vertical leg 32 of the resilient catch 22. In this way there is in effect a double latch, either of which is sufficient to maintain the latching engagement of the mechanism. The actuating wand 19 is shown with its working end inserted into the latch mechanism by projection upward through the circular aperture 48 in the cover shell 26 and aperture 35 in the channel plate 25, but before being actuated to unlatch the latching mechanism. If the actuating wand 19 were removed from FIG. 4, the remainder of the figure would stay exactly as illustrated.

Consider now FIGS. 7 through 9 for an understanding of the manner of unlatching the latch mechanism. FIG. 7 illustrates the condition where the actuating wand 19 has been rotated 180° so that the circular cam 46 has laterally pressed against the side edge of the shelf 33 on the vertical leg 32 of the resilient catch 22 and has caused the leg 32 to pivot outward through the open end 50 of the cover shell 26 by rotation around the pivot pin 21. This causes the projections 36 of the channel plate 25 to slip off of the upper surface of the shelf 33 and thereby be unlatched. Simultaneously, as the leg 32 of the resilient catch 22 pivots outward, the generally horizontal leg 30 of the resilient catch 22 slides to the left so that the end of the horizontal leg 30 moves sufficiently to disengage from the horizontal slot 39 in the catch pin 38. With the catch pin 38 disengaged, it is able to move downward through the aperture 49 in the latching plate 20 so that the entire track section 10 and those portions of the latch mechanism secured thereto can swing downward away from the latching plate 20 into the phantom line position shown in FIG. 1. A cubicle curtain can, for example, then be replaced, or some other article such as an I.V. carrier may be inserted or removed.

It should be noted that the actuating wand 19 is held captive within the cover shell 26 and will remain that way unless the actuating wand is rotated an additional 180° to allow the circular cam 46 to register with the aperture 48 in the cover shell and thereby be removable.

The mechanism is relatched in the same way that it was unlatched. With the wand 19 in position as shown in FIG. 7, the pivotable track section 10 is swung upward so that the upper edge of the projections 36 first engage with the bottom of the shelf 33 and drive the leg 32 outward into the position shown in FIG. 7 while simultaneously moving the aperture 31 into registry with the aperture 49 so that the catch pin 38 can easily project upward therethrough. With the track held in the position as shown in FIG. 7 supported by the actuating wand 19, the wand 19 is then rotated 180° so that it assumes the position in FIG. 4, thereby relatching the mechanism by re-establishing the interlatched conditions shown in FIG. 4. The actuating wand may then be removed and the mechanism is secure.

Having now described the invention in connection with a particularly illustrated embodiment thereof, it will be appreciated that modifications and variations of the invention may now naturally occur from time to time to those persons normally skilled in the art without departing from the essential scope or spirit of the invention, and accordingly it is intended to claim the invention broadly as well as specifically as indicated by the appended claims.

What is claimed is:

1. A latching track system comprising in combination (a) a first track section fixable in position to a supporting surface, (b) a second track section downwardly swingable with respect to and being a continuation of said first track section, said second track section having a hinge connection at one end to the said fixable position first track section, and having a free end at the end remote from the hinge connection, (c) a track latching mechanism having, (1) a first section fixedly secured to the said free end of the said swingable track, and (2) a second section fixedly securable to a supporting surface, said first and second track latching sections being releasably interlatchable with one another, and (d) remotely operable rotatable actuating means engagable with said track latching mechanism, and effective for latching and unlatching said mechanism to respectively secure the said free end of said swingable track section to its associated supporting surface and to release it therefrom by rotation thereof, said remotely operable actuating means being directly engagable with both of said first and second sections of said track latching mechanism when rotating to latch and unlatch said mechanism.

2. A track system, as set forth in claim 1 wherein said track latching mechanism includes first and second commonly actuatable latches, said first and second latching mechanism sections each comprising a part of both of said first and second latches.

3. A track system as set forth in claim 2 wherein said remotely operable actuating means is an elongated actuating wand having an actuating cam at one end, said actuating cam being insertable into said latching mechanism first section and being rotatable therein to engage a deflectable part of said latching mechanism second section to simultaneously release both of said first and second latches.

4. A track system as set forth in claim 1 wherein said remotely operable actuating means becomes releasably captive to said first section of said track latching mechanism when said latching mechanism is actuated to unlatch said swingable track.

5. A track system as set forth in claim 1 wherein said remotely operable actuating means is an elongated actuating wand having an actuating cam at one end, said actuating cam being insertable into said latching mechanism first section and being rotatable therein to engage a deflectable part of said latching mechanism second section to release the latch.

6. A track system as set forth in claim 5 wherein said remotely operable actuating means is an elongated actuating wand having a cam actuator at one end, said cam actuator being insertable into said latching mechanism first section and being rotatable therein to engage a deflectable part of said latching mechanism second section to release the latch, said actuating wand is releasably captive to said latching mechanism first section when said latch is released.

7. A track system as set forth in claim 5 wherein said actuating cam is surmounted by a guide end post which is projectable into a guide aperture formed in a portion of said first section of said track latching mechanism.

8. A track system as set forth in claim 1 wherein said track latching mechanism second section comprises a shiftable leg having an aperture therethrough, and wherein said track latching mechanism first section comprises a slotted pin, said pin being partially projected through the plane of said shiftable leg aperture with a portion of said shiftable leg projected into the slot of said slotted pin to interlatch therewith when said latching mechanism is in its latched condition.

9. A track system as set forth in claim 1 wherein said track latching mechanism second section comprises a swingable leg having a shelf formation projecting therefrom, and said track latching mechanism first section comprises a projection which overlies and seats on said swingable leg shelf formation to interlatch therewith when said latching mechanism is in its latched condition.

10. A latching track system comprising in combination (a) a first track section fixable in position to a supporting surface, (b) a second track section swingable with respect to and being a continuation of said first track section, said second track section having a hinge connection at one end to the said flexible position first track section, and having a free end at the end remote from the hinge connection, (c) a track latching mechanism having, (1) a first section fixedly secured to the said free end of the said swingable track, and (2) a second section fixedly securable to a supporting surface, said first and second track latching sections being releasably interlatchable with one another, said track latching mechanism second section comprising a shiftable leg having an aperture therethrough, and said track latching mechanism first section comprising a slotted pin, said pin being partially projected through the plane of said shiftable leg aperture with a portion of said shiftable leg projected into the slot of said sloted pin to interlatch therewith when said latching mechanism is in its latched condition, and further wherein said track latching mechanism second section comprises a swingable leg having a shelf formation projecting therefrom, and said track latching mechanism first section comprises a projection which overlies and seats on said swingable leg shelf formation to interlatch therewith when said latching mechanism is in the latched condition, (d) remotely operable actuating means engagable with said track latching mechanism, and effective for latching and unlatching said mechanism to respectively secure the said free end of said swingable track section to its associated supporting surface and to release it therefrom.

11. A track system as set forth in claim 10 wherein the said apertured shiftable leg and said swingable leg having the shelf formation are coupled together as parts of a resilient generally L-shaped catch which is pivotally supported from a latching plate securable to a supporting surface, and the said slotted pin and projection parts of said latch mechanism first section are both parts of a common catch pin channel plate.

12. A latching track system comprising in combination (a) a first track section fixable in position to a supporting surface, (b) a second track section swingable with respect to and being a continuation of said first track section, said second track section having a hinge connection at one end to the said fixable position first track section, and having a free end at the end remote from the hinge connection, (c) a track latching mechanism having, (1) a first section fixedly secured to the said free end of the said swingable track, and (2) a second section fixedly securable to s supporting surface, said first and second track latching sections being releasably interlatchable with one another, said track latching mechanism second section comprising a swingable leg having a shelf formation projecting therefrom, said track latching mechanism first section comprising a projection which overlies and seats on said swingable leg shelf formation to interlatch therewith when said latching mechanism is in its latched condition, (d) remotely operable actuating means engagable with said track latching mechanism, and effective for latching and unlatching said mechanism to respectively secure the said free end of said swingable track section to its associated supporting surface and to release it therefrom, said remotely operable actuating means being an elongated actuating wand having an actuating cam at one end, said actuating cam being insertable into said latching mechanism first section and being rotatable therein to directly engage both the projection and a side surface of said swingable leg shelf formation to swing said swingable leg laterally out from under the said projection which overlies and seats thereon to thereby release the latch.

13. A track system as set forth in claim 12 wherein said track latching mechanism second section comprises a shiftable leg having an aperture therethrough, and wherein said track latching mechanism first section comprises a slotted pin, said pin being partially projected through the plane of said shiftable leg aperture with a portion of said shiftable leg projected into the slot of said slotted pin to interlatch therewith when said latching mechanism is in the latched condition.

14. A track system as set forth in claim 13 wherein said apertured shiftable leg and said swingable leg having the shelf formation are coupled together as parts of a resilient generally L-shaped catch which is pivotally supported from a latching plate securable to a supporting surface, and the said slotted pin and projection parts of said latch mechanism first section are both parts of a common catch pin channel plate.

* * * * *